US008382543B1

(12) United States Patent
Donahue

(10) Patent No.: US 8,382,543 B1
(45) Date of Patent: Feb. 26, 2013

(54) ADJUSTABLE FIN

(75) Inventor: Christopher Donahue, Bethalto, IL (US)

(73) Assignee: Ultimate Innovative Design, Inc., Edwardsville, IL (US)

( * ) Notice: Subject to any disclaimer, the term of this patent is extended or adjusted under 35 U.S.C. 154(b) by 0 days.

(21) Appl. No.: 12/939,977

(22) Filed: Nov. 4, 2010

Related U.S. Application Data

(63) Continuation of application No. 12/483,688, filed on Jun. 12, 2009, now abandoned.

(60) Provisional application No. 61/258,024, filed on Nov. 4, 2009.

(51) Int. Cl.
*A63B 31/08* (2006.01)

(52) U.S. Cl. ..... 441/64

(58) Field of Classification Search ..... 441/55, 441/60–64

See application file for complete search history.

(56) References Cited

U.S. PATENT DOCUMENTS

| | | | | |
|---|---|---|---|---|
| 2,980,926 | A * | 4/1961 | Wolshin | 441/64 |
| 3,037,219 | A * | 6/1962 | Webb | 416/72 |
| 3,665,535 | A * | 5/1972 | Picken | 441/64 |
| 4,250,584 | A * | 2/1981 | Korn | 441/61 |
| 6,224,443 | B1 * | 5/2001 | Mehrmann et al. | 441/64 |
| 7,828,615 | B2 * | 11/2010 | Bonis et al. | 441/61 |
| 7,997,948 | B2 * | 8/2011 | Fraser et al. | 441/64 |

* cited by examiner

*Primary Examiner* — Daniel Venne
(74) *Attorney, Agent, or Firm* — Singleton Law Firm, P.C.

(57) ABSTRACT

An adjustable fin apparatus adjustable between a first expanded position including a pair of inner elongated blades 12 and a pair of outer elongated blades 14; the blades 12, 14 are mounted to a blade housing portion 16 comprising an upper housing element 18 and a lower housing element 20; the lower blade housing element 20 comprises an elongate shape having a slot 22 formed therein along a portion of the length of the lower blade housing element 20; the inner elongated blades 12 comprise an inner edge 26 and an outer edge 28 and a bore 30 is located at an end thereof; an outer elongated blade 14 defines an inner edge 32 and an outer edge 34; and the upper blade housing element 18 comprises an elongate shape generally corresponding to the elongate shape of the lower blade housing element 20.

1 Claim, 3 Drawing Sheets

ADJUSTABLE FIN

The present application is a continuation of U.S. patent application Ser. No. 12/483,688 and claims priority to U.S. Patent Provisional Patent Application No. 61/258,024, and such applications are incorporated herein by reference.

BACKGROUND OF THE INVENTION

1. Field of the Invention

In the field of swim fins, there are various fins for propelling a swimmer through water. The present invention relates to a swim fin apparatus with an adjustable fin area.

2. Description of the Related Art

Traditionally, swim fins include a blade with a blade area that is used to produce a propulsive force when a user is water-kicking with the swim fin. The blade area is typically a fixed size. Generally, a fin with a large blade area produces more propulsive force than a fin with a blade area that is smaller. However, the user of the fin must exert more force in order to use the fin with a larger blade area than the fin with a smaller blade area. Since the blade area of a fin is typically one piece of material with a fixed blade area, a particular user may need different fins for different swimming environments. Additionally, during transportation of fins, the fins are large and bulky and are not easily stored or packed for transportation.

There is a need in the part for a fin that has adjustable blade area as well as a fin that reduces in size during transportation.

BRIEF DESCRIPTION OF THE DRAWINGS

Referring now to the drawings in which like reference numbers represent corresponding parts throughout.

DETAILED DESCRIPTION OF PREFERRED EMBODIMENT

In the following description, reference is made to the accompanying drawings which form a part hereof, and which is shown, by way of illustration, several embodiments of the present invention. It is understood that other embodiments may be utilized and structural changes may be made without departing from the scope of the present invention.

The preferred embodiment of the present invention comprises a fin for swimming, snorkeling and scuba diving that is adjustable to fit the size of the swimmer/diver and the type of swimming or diving that the person will undertake. Smaller people require a smaller fin with less fin area to provide the person the appropriate agility in the water and to prevent the person from becoming exhausted from operating an oversized fin. On the contrary, a larger person needs additional fin area to propel the person's larger body and, normally, the person's additional size provides the additional strength necessary to operate the fin. Moreover, it would be desirable to provide a collapsible fin for easy transport and storage.

Figure 1:
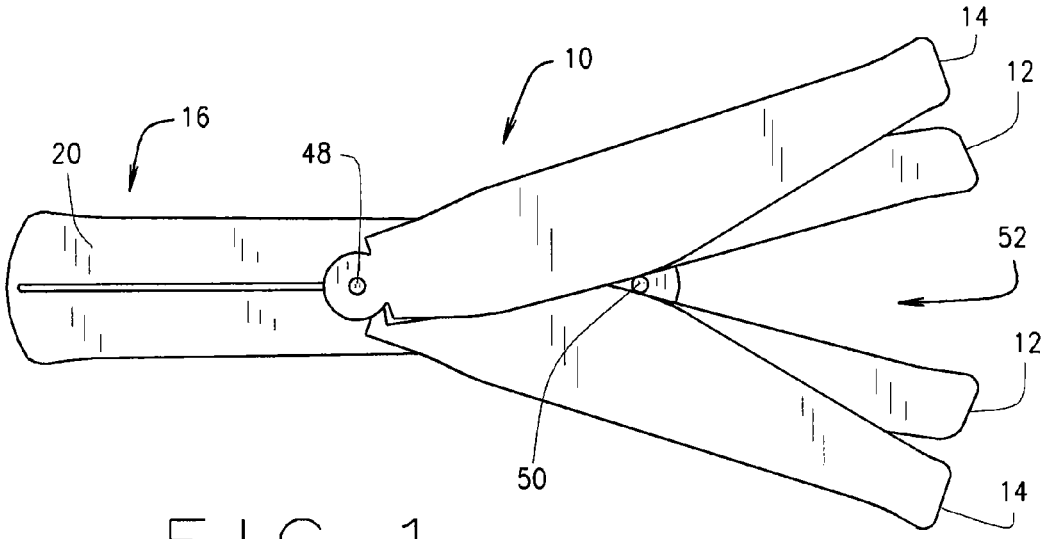
FIG. 1 is a plan view of a fin in an expanded state according to an embodiment of the present invention.
Figure 2:
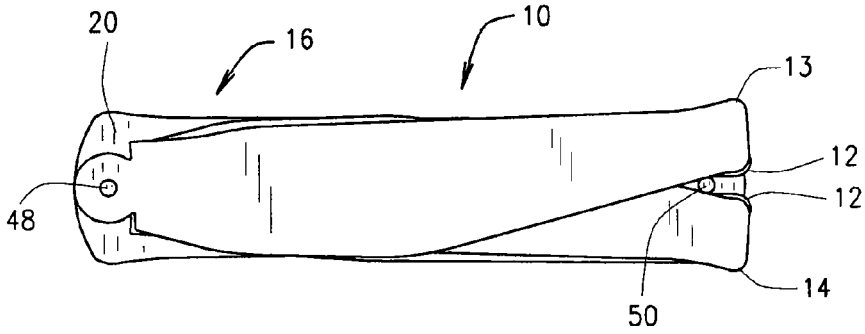
FIG. 2 is a plan view of a fin in a retracted state according to an embodiment of the present invention.

Referring now to the figures there is shown an embodiment of the present invention comprising an adjustable fin 10 which is adjustable between a first expanded position, as shown in FIG. 1, and a second retracted position as shown in FIG. 2. The adjustable fin 10 comprises a pair of inner elongated blades 12 and a pair of outer elongated blades 14 all formed of a polymeric material. An embodiment of the invention shows the blades 12, 14 formed of polycarbonate or other plastic material, but the fin 10 may be formed of any suitable polymeric material used for a fin known by those having ordinary skill in the art. Additionally, it is contemplated that the fin 10 may comprise metallic compounds such as thin blades of titanium or aluminum. The blades 12, 14 are mounted to a blade housing portion 16 comprising an upper housing element 18 and a lower housing element 20. The thickness of the blades 12, 14 is small in comparison to the blades' other dimensions (see FIG. 8).

Figure 3:
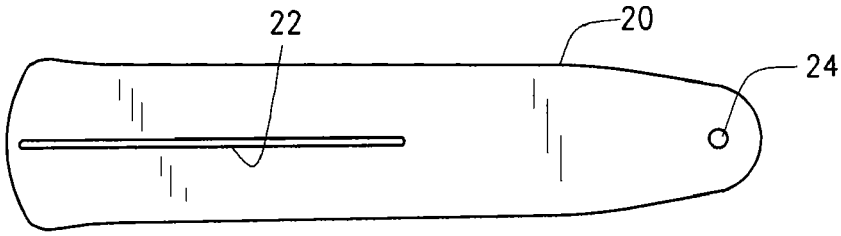
FIG. 3 is a plan view of a lower blade housing element of a fin according to an embodiment of the present invention.

As can be seen in FIG. 3, the lower blade housing element 20 comprises an elongate shape having a slot 22 formed therein along a portion of the length of the lower blade housing element 20. At an end of the blade housing element 20 is located a bore 24.

Figure 4:
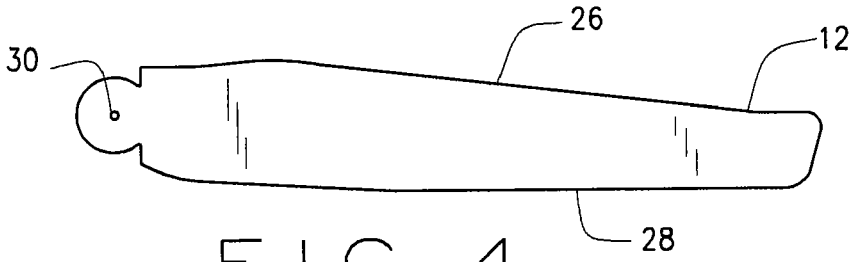
FIG. 4 is a plan view of an inner elongate blade portion of a fin according to an embodiment of the present invention.
Figure 5:
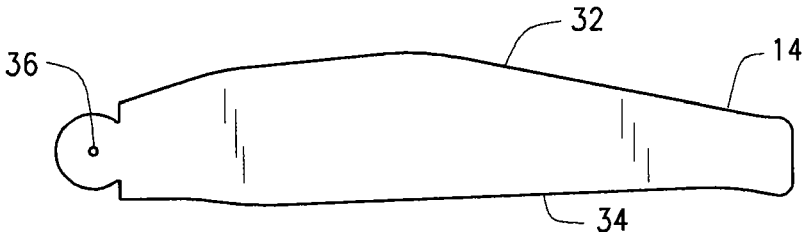
FIG. 5 is a plan view of an outer elongate blade portion of a fin according to an embodiment of the present invention.

Referring to FIG. 4, the inner elongated blades 12 comprise an inner edge 26 and an outer edge 28. A bore 30 is located at an end thereof. Shown in FIG. 5, is an outer elongated blade 14 defining an inner edge 32 and an outer edge 34. The outer elongated blade 14 also forms a bore 36 at an end thereof and comprises a different profile for the outer periphery of the blade 14 than the blade 12, the reason for which will become clear below.

Figure 6:
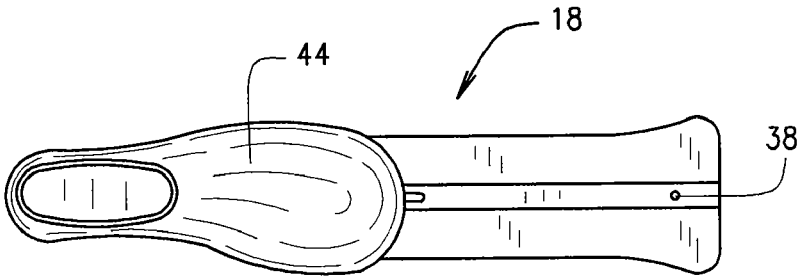
FIG. 6 is a plan view of an upper blade housing element of a fin according to an embodiment of the present invention.
Figure 7:
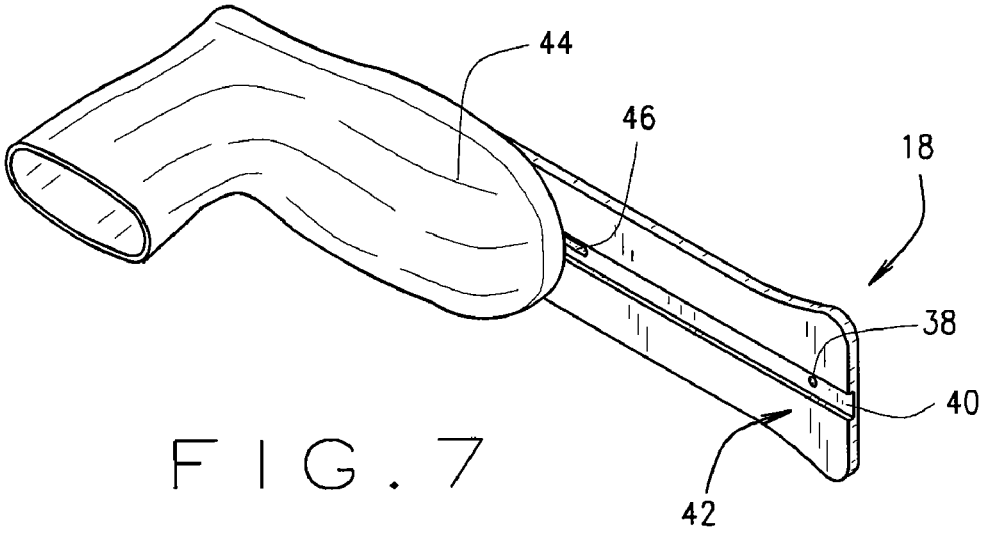
FIG. 7 is an oblique view of an upper blade housing element of a fin according to an embodiment of the present invention.

An upper blade housing element 18 is shown in FIGS. 6 and 7. The upper blade housing element 18 comprises an elongate shape generally corresponding to the elongate shape of the lower blade housing element 20. A bore 38 is formed in an end of the upper blade housing element 18. The upper blade housing element 18 further defines a recessed portion 40 in an upper surface 42 of the upper blade housing element 18. Within a portion of the recessed portion 40 is a slot 46 corresponding the slot 22 of the lower blade housing element 20. A boot 44 is further attached to the upper surface 42 of the upper blade housing element 18.

Figure 8:
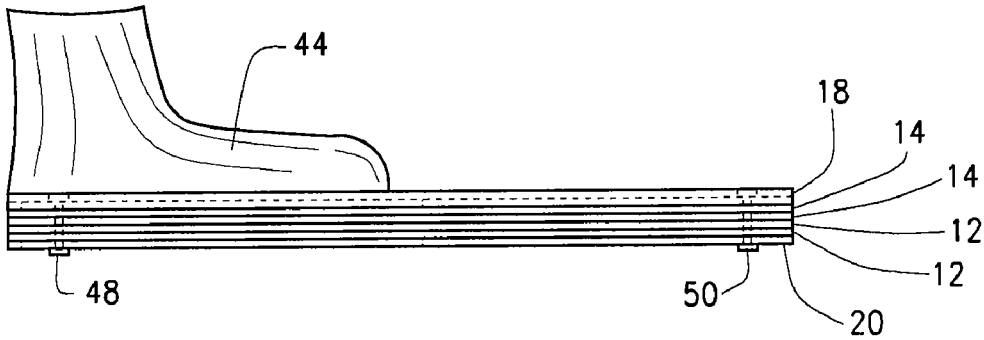
FIG. 8 is a side view of a fin in a retracted state according to an embodiment of the present invention.
Figure 9:
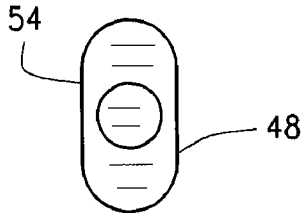
FIG. 9 is a plan view of a fastener according to an embodiment of the present invention.

Referring to FIG. 8, the fin 10 is assembled by stacking two inner elongated blades 12 upon the lower blade housing element 20 and stacking two outer elongated blades 14 upon the inner elongated blades 12. The upper blade housing element 18 is then placed upon the outer elongated blades 14. A first fastener 48 is then placed though the slot 22 the lower blade housing element 20, the bores 30 of the pair of inner elongated blades 12, the bores 36 of the pair of outer elongated blades 14 and finally through the slot 46 of the upper blade housing element 18. The fastener 48 features an ovular head 54 (FIG. 9) that can be retained within the recessed portion 40 to aid in tightening and loosening the fastener 48. A second fastener 50 is inserted through the corresponding bores 24 and 38 but not through the inner or outer elongate blades 12 and 14.

When the fasteners 48 and 50 are loosened, the blades may be moved from the positions of FIG. 1 and FIG. 2 (and positions in between) by allowing the fastener 48 to move within the slots 22 and 46 of the upper and lower blade housing elements 18 and 20. Moreover, when moving between the positions of FIG. 1 and FIG. 2, the edges 26 and 32 of the inner and outer elongated blades 12 and 14 contact the fastener 50 thereby forcing the inner and outer elongated blades 12 and 14 outwardly as the blades 12 and 14 are moved from the retracted position of FIG. 2 to the expanded position of FIG. 1 by virtue of the curved shape of the edges 26 and 32. As will be understood by one of ordinary skill in the art after reviewing the present disclosure, the shape chosen for the edges 26 and 32 affect how far outwardly the blades 12 and 14 are forced by the fastener 50. As seen in FIG. 1 the present embodiment allows for a gap 52 between the inner blades 12, although one of ordinary skill upon reviewing the present disclosure would understand that changing the shape of the inner and outer blades 12 and 14 further can be shaped to maximize or minimize (or even eliminate) this gap 52 and also to determine the overall shape of the fin 10.

It can further be understood by one of ordinary skill in the art after reviewing this disclosure that the pairs of inner elongate blades 12 and/or the pairs of outer elongate blades 14 need not be mirrored pairs but may be individually sized to provide any desired shape of the fin.

What is claimed is:

1. An adjustable fin apparatus adjustable between an expanded position and a retracted position, comprising:

a pair of inner elongated blades and a pair of outer elongated blades; the inner elongated blades and the outer elongated blades are mounted to a blade housing portion comprising an upper housing element and a lower housing element;

the lower housing element comprises an oblong shape having a slot formed therein along a portion of the length of the lower housing element;

the inner elongated blades comprise an inner edge and an outer edge and a bore is located at an end of each inner elongated blade; an outer elongated blade defines an inner edge and an outer edge; and the upper housing element comprises an oblong shape generally corresponding to the oblong shape of the lower housing element.

* * * * *